US007367393B2

(12) United States Patent
Vachon

(10) Patent No.: US 7,367,393 B2
(45) Date of Patent: May 6, 2008

(54) PRESSURE MONITORING OF CONTROL LINES FOR TOOL POSITION FEEDBACK

(75) Inventor: Guy Vachon, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 235 days.

(21) Appl. No.: 11/140,186

(22) Filed: May 27, 2005

(65) Prior Publication Data

US 2005/0263279 A1 Dec. 1, 2005

Related U.S. Application Data

(60) Provisional application No. 60/576,202, filed on Jun. 1, 2004.

(51) Int. Cl.
*E21B 47/00* (2006.01)

(52) U.S. Cl. ..... 166/250.01; 166/386

(58) Field of Classification Search ..... 166/250.01, 166/386, 334.1
See application file for complete search history.

(56) References Cited

U.S. PATENT DOCUMENTS 4,174,729 A 11/1979 Roark et al.
4,470,430 A 9/1984 Lancaster
5,176,164 A 1/1993 Boyle
5,499,533 A 3/1996 Miller et al.
5,547,029 A 8/1996 Rubbo et al.
5,925,879 A 7/1999 Hay
6,046,685 A 4/2000 Tubel
6,550,322 B2 4/2003 Sweetland et al.
6,629,564 B1 10/2003 Ramakrishnan et al.
6,668,936 B2 * 12/2003 Williamson et al. ..... 166/375
2003/0132006 A1 * 7/2003 Bussear et al. ..... 166/386
2004/0035577 A1 2/2004 Ramakrishnan et al.

* cited by examiner

*Primary Examiner*—Jennifer H. Gay
*Assistant Examiner*—Brad Harcourt
(74) *Attorney, Agent, or Firm*—Madan, Mossman & Sriram, P.C.

(57) ABSTRACT

A flow control device for use in a wellbore to allow flow of formation fluid into the wellbore comprises a valve member adapted to move when disposed in the wellbore. A fluid line supplies a working fluid under pressure to move the valve member to allow the fluid to flow into the wellbore. A sensor in the wellbore, and associated with the fluid line, provides an indication of a position of the valve member. A method of determining a state of a flow control tool within a wellbore comprises supplying fluid under pressure to the flow control tool to move a flow control member of the tool into the state. Pressure of the supplied fluid is detected downhole. The state of the flow control device is determined from the detected pressure of the supplied fluid.

29 Claims, 6 Drawing Sheets

PRESSURE MONITORING OF CONTROL LINES FOR TOOL POSITION FEEDBACK

CROSS-REFERENCE TO RELATED APPLICATIONS

This application claims the benefit of U.S. Provisional Application No. 60/576,202, filed Jun. 1, 2004, which is incorporated herein by reference.

BACKGROUND OF THE INVENTION

1. Field of the Invention

The invention relates generally to the hydraulic control of downhole tools and, particularly to methods and devices for determining the state of such hydraulically-actuated tools.

2. Description of the Related Art

Production of hydrocarbons from a downhole well requires subsurface production equipment to control the flow of hydrocarbon fluid into the production tubing. Typical flow control equipment might include a sliding sleeve valve assembly or other valve assembly wherein a sleeve is moved between open and closed positions in order to selectively admit production fluid into the production tubing. The valve assembly is controlled from the surface using hydraulic control lines or other methods.

In a simple system, a sleeve valve would be moveable between just two positions or states: fully opened and fully closed. More complex systems are provided where a well penetrates multiple hydrocarbon zones, and it is desired to produce from some or all of the zones. In such a case, it is desirable to be able to measure and control the amount of flow from each of the zones. In this instance, it is often desirable to use flow control devices that may be opened in discrete increments, or states, in order to admit varying amounts of flow from a particular zone. Several "intelligent" hydraulic devices are known that retain information about the state of the device. Examples of such devices include those marketed under the brand names HCM-A In-Force™ Variable Choking Valve and the In-Force™ Single Line Switch, both of which are available commercially from Baker Oil Tools of Houston, Tex. These devices incorporate a sliding sleeve that is actuated by a pair of hydraulic lines that move the sleeve within a balanced hydraulic chamber. A "J-slot" ratchet arrangement is used to locate the sleeve at several discrete positions that permit varying degrees of fluid flow through the device.

Because these devices are capable of being controlled between multiple states, or positions, determination and monitoring of the positions of the devices is important. To date, position determination has been accomplished by measurement of the amount of hydraulic fluid that is displaced within the control lines as the device is moved between one position and the next. Measuring displacement of hydraulic fluid will provide an indication of the particular state that the tool has moved to because differing volumes of fluid are displaced during each movement. In some instances, however, such as with a subsea pod, it may not be possible to measure fluid volume. Also, the fluid volume measurement technique may be inaccurate at times for a variety of reasons, including leaks within the hydraulic control lines and connections or at seals that lead to fluid loss, which leads to an incorrect determination of position. In addition, the hydraulic control lines may expand under pressure (storage effects) or become distorted due to high temperatures within the wellbore. In long lines, the additional storage volume in such expansion/distortion may be larger than the normally small differences in fluid volume between different movements and lead to inaccurate determinations of position.

The present invention addresses some of the problems of the prior art noted above.

SUMMARY OF THE INVENTION

In one aspect of the present invention, a flow control device for use in a wellbore to allow flow of formation fluid into the wellbore comprises a valve member adapted to move when disposed in the wellbore. A fluid line supplies a working fluid under pressure to move the valve member to allow the fluid to flow into the wellbore. A sensor in the wellbore, and associated with the fluid line, provides an indication of a position of the valve member.

In another aspect, a downhole flow control device comprises a hydraulically-actuated sleeve valve that is operable between a first position wherein the valve is in a first fluid flow state and a second position wherein the valve is in a second fluid flow state. A hydraulic control line is operably associated with the sleeve valve for supplying hydraulic fluid to operate the valve between states. A downhole pressure sensor operably associated with the hydraulic control line detects fluid pressure therein to provide an indication of the state of the sleeve valve.

In another aspect, a method of determining a state of a flow control tool within a wellbore comprises supplying fluid under pressure to the flow control tool to move a flow control member of the tool into the state. Pressure of the supplied fluid is detected downhole. The state of the flow control device is determined from the detected pressure of the supplied fluid.

In yet another aspect of the present invention, a method of determining the state of a flow control tool within a wellbore comprises detecting a fluid flow downhole within a hydraulic supply conduit in fluid communication with the flow control tool. The state of the flow control tool is determined from the detected fluid flow.

BRIEF DESCRIPTION OF THE DRAWINGS

For detailed understanding of the present invention, references should be made to the following detailed description of the preferred embodiment, taken in conjunction with the accompanying drawings, in which like elements have been given like numerals, wherein.

DETAILED DESCRIPTION OF THE EMBODIMENTS

Figure 1:
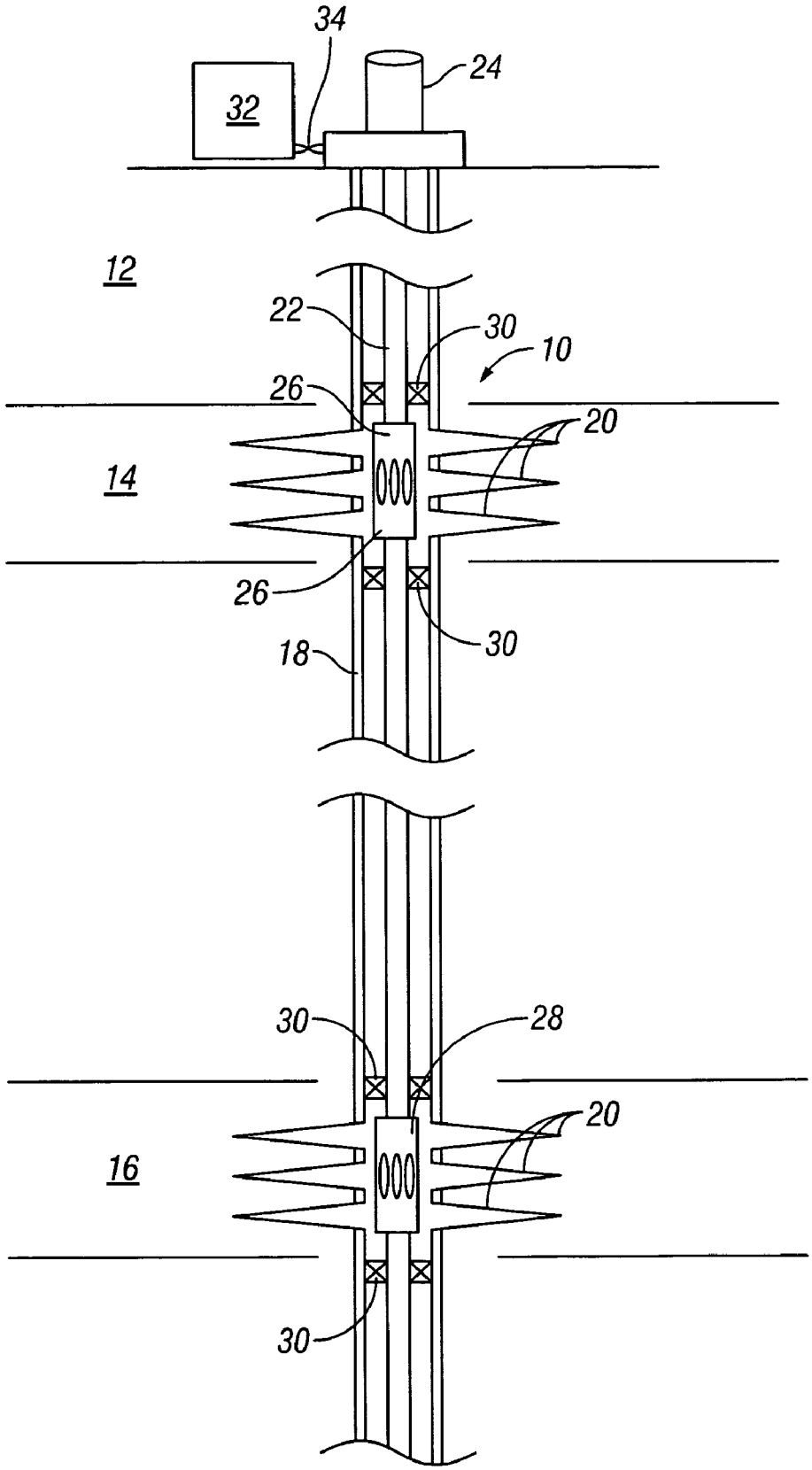
FIG. 1 is a schematic depiction of an exemplary wellbore system wherein multiple hydrocarbon zones and fluid entry points.

FIG. 1 illustrates an exemplary production well 10 that penetrates the earth 12 into multiple hydrocarbon zones, such as zones 14, 16. The well 10 is cased with casing 18, and perforations 20 are disposed through the casing 18 proximate each of the zones 14, 16 to provide a flow point for hydrocarbon fluids within the zones 14, 16 to enter the well 10. It is noted that, although a single wellbore is shown, there may, in practice, be a plurality of multilateral wellbores, each penetrating one or more zones such as zones 14, 16. Additionally, although only two zones are shown, those skilled in the art will recognize that there may be more such zones.

A production tubing string 22 is disposed within the well 10 from a wellhead 24 and includes flow control devices 26, 28 located proximate the zones 14, 16, respectively. Packers 30 isolate the flow control devices 26, 28 within the well 10. In one embodiment, each of the flow control devices 26, 28 is a sliding sleeve flow control device that is capable of more than two operable positions, also called open/closed states. Examples of suitable flow control devices for this application include those marketed under the brand names HCM-A In-Force™ Variable Choking Valve and the In-Force™ Single Line Switch, both of which are available commercially from Baker Oil Tools of Houston, Tex.

A monitoring and control station 32 is located at the wellhead 24 for operational control of the flow control devices 26, 28. Hydraulic control lines, generally shown at 34 extend from monitoring and control station 32 down to the flow control devices 26, 28. The monitoring and control station 32 is of a type known in the art for control of hydraulic downhole flow control devices, and is described in more detail below in reference to FIG. 5.

Figure 2:
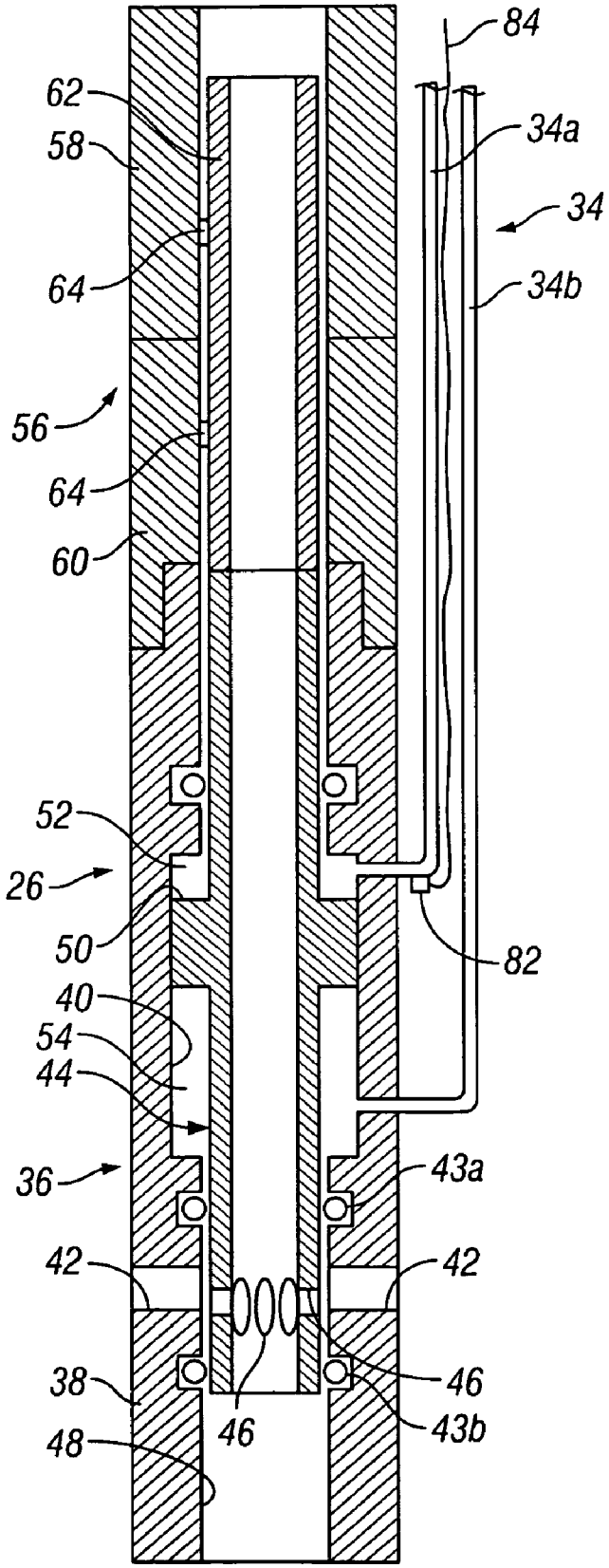
FIG. 2 is a schematic depiction, in side cross-section, of an exemplary sliding sleeve valve assembly incorporating a fluid pressure sensor system in accordance with the present invention.

FIG. 2 illustrates an exemplary individual flow control device 26 and illustrates its interconnection with an exemplary pressure sensor position detection system. The flow control device 26 is illustrated in simplified schematic form for ease of description. In practice, the flow control device 26 may be an HCM-A In-Force™ Variable Choking Valve brand flow control device marketed by Baker Oil Tools of Houston, Tex. The device 26 includes a sliding sleeve assembly sub 36 having a tubular outer housing 38 that defines a fluid chamber 40 therewithin. Fluid openings 42 are disposed through the housing 38 below the fluid chamber 40. A sliding sleeve 44 is retained within the housing 38 and includes a number of fluid ports 46 disposed radially therethrough. Seals 43*a* and 43*b* are disposed in outer housing 38 above and below fluid openings 42. When the sliding sleeve 44 is axially displaced such that piston 50 is near the bottom of chamber 40, the ports 46 are below lower seal 43*b* and there is no flow into bore 48 of housing 38. Depending upon the axial position of the sliding sleeve 44 within the housing 38 and within the seals 43*a,b*, the ports 46 of the sleeve 44 can be selectively aligned with the fluid openings 42 in the housing 38 to permit varying degrees of fluid flow into the bore 48 of the housing 38 as the ports 46 overlap the openings 42 in varying amounts. The sliding sleeve 44 also includes an enlarged outer piston portion 50 that resides within the chamber 40 and separates chamber 40 into an upper chamber 52 and a lower chamber 54. A seal (not shown) on the outer diameter of piston 50 hydraulically isolates upper chamber 52 and lower chamber 54. Piston 50 exposes substantially equal piston area to each of chambers 52 and 54 such that equal pressures in chambers 52 and 54 result in substantially equal and opposite forces on piston 50 such that piston 50 is considered "balanced". To move piston 50, a higher pressure is introduced in one chamber and fluid is allowed to exit from the other chamber at a lower pressure, resulting in an unbalanced force on piston 50, and thereby moving piston 50 in a desired direction.

Hydraulic control lines 34*a* and 34*b* are operably secured to the housing 38 to provide fluid communication into and out of each of the fluid receiving chambers 52,54. As those skilled in the art will recognize, the sliding sleeve 44 may be axially moved within the housing 38 by transmission of hydraulic fluid into and out of the fluid receiving chambers 52,54. For example, if it is desired to move the sleeve 44 downwardly with respect to the housing 38, hydraulic fluid is pumped through the control line 34*a* and into only the upper fluid receiving chamber 52. This fluid exerts pressure upon the upper face of the piston 50, urging the sleeve 44 downwardly. As the sleeve 44 moves downwardly, hydraulic fluid is expelled from the lower fluid receiving chamber 54 through control line 34*b* toward the surface of the well 10. Conversely, if it is desired to move the sleeve 44 upwardly with respect to the housing 38, hydraulic fluid is pumped through control line 34*b* into the lower fluid receiving chamber 54 to exert pressure upon the lower side of the piston portion 50. As the sleeve 44 moves upwardly, hydraulic fluid is expelled from the upper fluid receiving chamber 52 through the control line 34*a*.

Figure 3A:
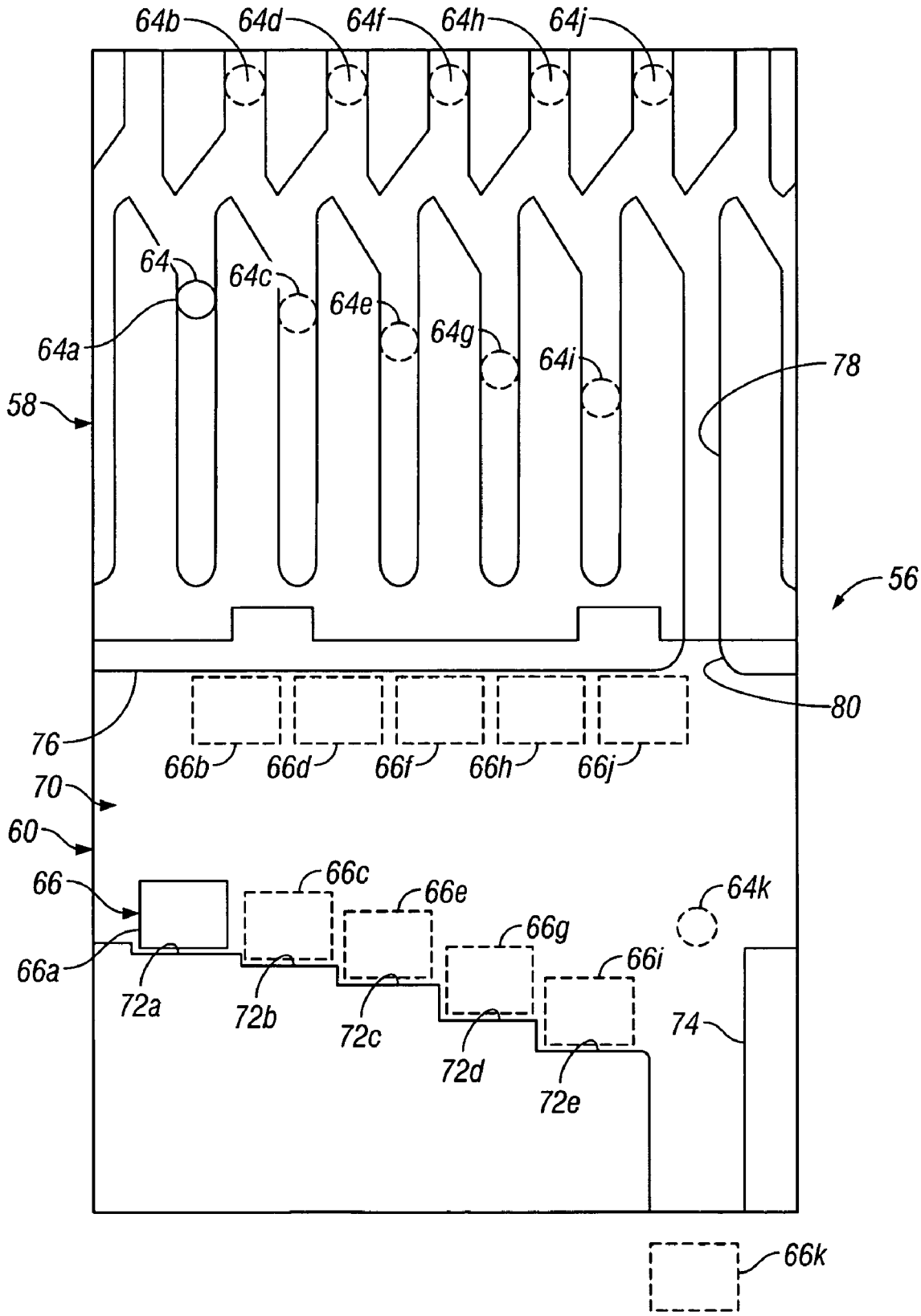
FIG. 3A is an illustration of a J-slot ratchet and lug arrangement according to one embodiment of the present invention.

In one embodiment, see FIG. 3A, a J-slot ratchet assembly sub 56 is secured to the upper end of the sliding sleeve valve housing 38. The ratchet assembly sub 56 serves to provide a number of preselected axial positions, or states, for the sliding sleeve 44 within the sleeve assembly sub 36, thereby providing a preselected amount of flow control due to the amount of axial overlap of fluid ports 46 with fluid openings 42. The ratchet assembly sub 56 includes a pair of outer housing members 58, 60 that abut one another and are rotationally moveable with respect to one another. A lug sleeve 62 is retained within the sub 56 and presents upper and lower outwardly extending lugs 64,66. The lugs 64, 66 engage lug pathways inscribed on the inner surfaces of the housing members 58, 60. These pathways are illustrated in FIG. 3A which depicts the inner surfaces of the outer housing members 58, 60 in an "unrolled" manner. The upper outer housing member 58 has an inscribed tortuous pathway 68 within which upper lug 64 resides. The lower housing member 60 features an inscribed lug movement area 70 having a series of lower lug stop shoulders 72*a*-72*e* that are arranged in a stair-step fashion. The stair step shoulders 72*a*-72*e* are related to the amount of axial overlap of fluid ports 46 with fluid openings 42. Lower lug passage 74 is located adjacent the stop shoulder 72*e*. Additionally, the lower housing member 60 presents an upper lug stop shoulder 76. An upper lug passage 78 is defined within the upper housing member 58 and, when the upper and lower housing members 58, 60 are rotationally aligned properly, the upper lug passage 78 is lined up with lug entry passage 80 so that upper lug 64 may move between the two housing members 58, 60.

Axial movement of the sliding sleeve 44 by movement of piston 50 as described above moves the abutting lug sleeve 62 axially within the ratchet assembly sub 56. As this occurs, the upper lug 64 is moved consecutively among lug positions 64*a*, 64*b*, 64*c*, 64*d*, 64*e*, 64*f*, 64*g*, 64*h*, 64*i*, and 64*j*. Finally, the upper lug 64 moves to its final lug position 64*k*, which corresponds to a fully closed position, or state, for the sliding sleeve assembly sub 36. Additionally, the lower lug 66 is moved consecutively through lug positions 66*a*-66*k*. When lug 66 is located adjacent upper shoulder 76, the fluid ports 46 are aligned with fluid openings 42 to provide a fully open flow condition. It can be seen that abutment of the lower lug 66 upon each of the lower shoulders 72*a*,72*e* results in a progressively lower axial position for the lug sleeve 62 with respect to the housing members 58, 60. These different axial positions result in different flow control positions or states for the sliding sleeve 44, by varying the amount of axial overlap of fluid opening 42 with flow ports 46 (see FIG. 2). As illustrated in FIG. 3A, the flow opening becomes progressively smaller as lower lug 66 moves from position 66*a* to 66*i* and is eventually closed at position 66*k*. When the lugs 64 and 66 are in the positions 64*k* and 66*k*, respectively, the sleeve 44 is moved downward such that ports 46 are below seal 43*b* and there is no flow. By proper selection of the step change between successive states, a predetermined amount of fluid can be required to move the sliding sleeve between successive states. In one embodiment, the amount of movement, and hence the amount of fluid required, is selected such that the difference in movement between each successive state is uniquely different. By such selection, the amount of fluid required for each movement is unique and the location of the sleeve can then be identified by the amount of fluid required to move the sleeve to a position.

Figure 3B:
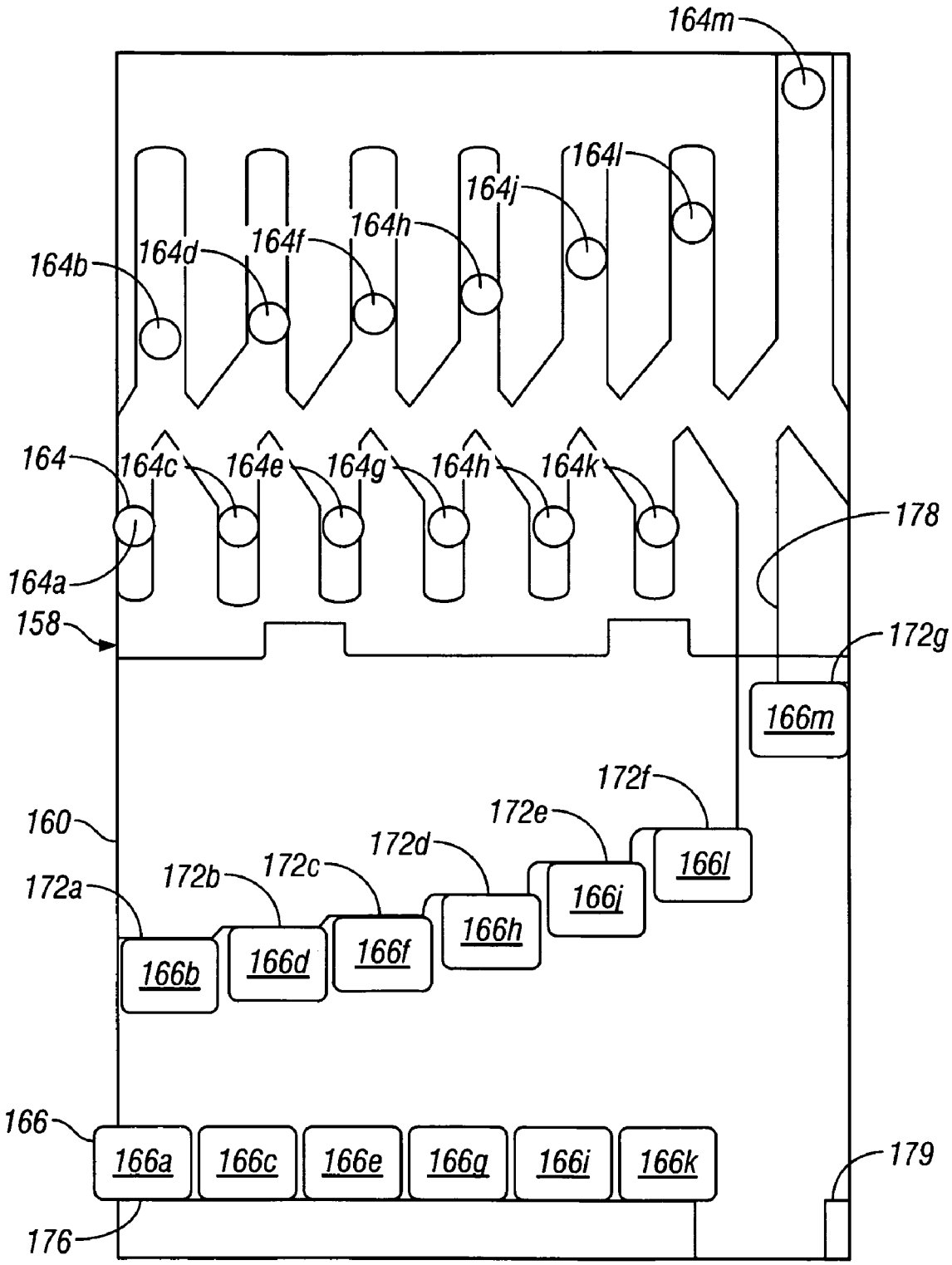
FIG. 3B is an illustration of an alternative J-slot ratchet and lug arrangement according to one embodiment of the present invention.

FIG. 3B shows another embodiment in which the J-slot arrangement is oriented such that the flow opening progressively increases as the system is operated. The J-slot arrangement on the inside of housings 160 and 158 are shown in an "unrolled" view. As shown in FIG. 3B, upper lug 164 moves through positions 164*a*-164*m* while lower lug 166 moves through positions 166*a*-166*m*, respectively. Lower shoulder 176 acts as a stop for lower lug 166. Upper shoulders 172*a-g* show a stair-step progression that is related to the amount of flow opening caused by the alignment of ports 46 and flow openings 42 in sleeve 44, however, as contrasted with FIG. 3A, when lug 166 is located against shoulder 176, there is no direct flow path through opening 42 and ports 46, but the ports are not below seal 43*b*. Therefore, there is some leakage into the bore 48 caused by clearances between sleeve 44 and housing 38, and is nominally referred to as the diffused position. As indicated with respect to FIG. 3A, the positions of shoulders 172*a-g* may be selected to provide unique indications of sleeve 44 position from the amount of fluid required to move sleeve 44 between consecutive positions. To close sleeve 44 using the arrangement of FIG. 3B, lugs 164 and 166 are moved downward through passages 178 and 179 until ports 46 are below seal 43*b* (see FIG. 2). It is noted that other lug and ratchet arrangements may be used within the scope of the invention.

Figure 4:
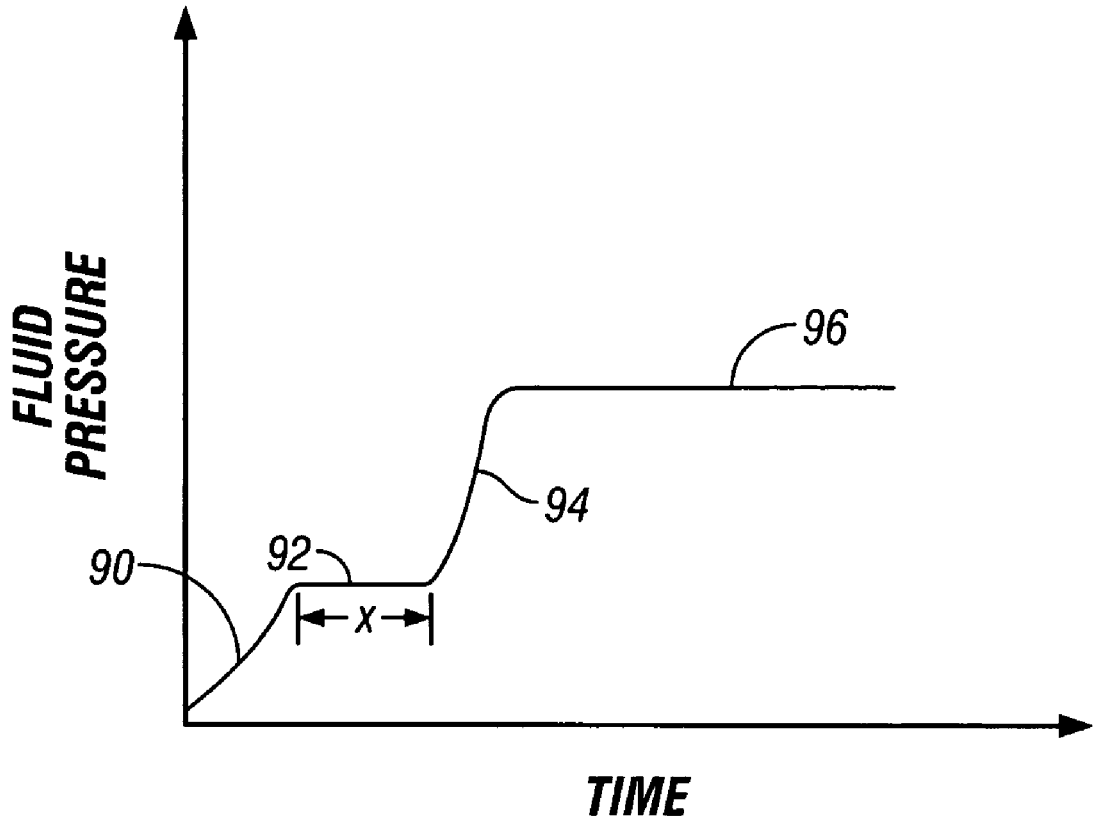
FIG. 4 is a graph of fluid pressure versus time.

FIG. 4 depicts a graph showing fluid pressure, as detected by the pressure sensor 82, versus time. The curve of the graph is illustrative of the fluid pressure within control line 34*a* during the process of moving the sliding sleeve 44. As hydraulic pressure is applied to the upper fluid receiving chamber 52, the fluid pressure within the control line 34*a* will begin to rise, as illustrated by the first section 90 of the graph. Fluid pressure will continue to rise until forces resisting piston motion, such as internal tool friction, are overcome. Once the friction is overcome piston 50 begins to move and, as a result, expels fluid from that lower chamber 54. At this point, the sleeve 44 is moving downwardly and the pressure increase in control line 34*a* stops and levels off at a substantially constant pressure during sleeve movement. After the sleeve 44 has been moved to its next position or state, as limited by the ratchet sub assembly 56, the fluid pressure within the line 34*a* will again begin to rise, as the sleeve 44 will move no further. The inclined portion 94 of the graph in FIG. 4 illustrates this. Ultimately, the fluid pressure within the line 34*a* will level off as the pump pressure reaches a stall pressure of the pump, or alternatively, the pressure reaches a relief value in the supply line.

By the proper selection of the stair-step shoulders of FIGS. 3A,B, the length of time (x) for the level pressure associated with sleeve movement (portion 92 of FIG. 4) correlates to particular movements between tool states for the flow control device 26. For example, movement of the device 26 from a position wherein the lower lug 66 is at 66*b* to a position wherein the lower lug 66 is at 66*c* will take less time than if the device is moved from a position wherein lug 66 is at 66*h* and then moved to 66*i*. Therefore, measurement of "x" will reveal the state that the tool 26 has been moved to. In one embodiment, the length of "x" is different for each particular movement of the tool 26.

Figure 5:
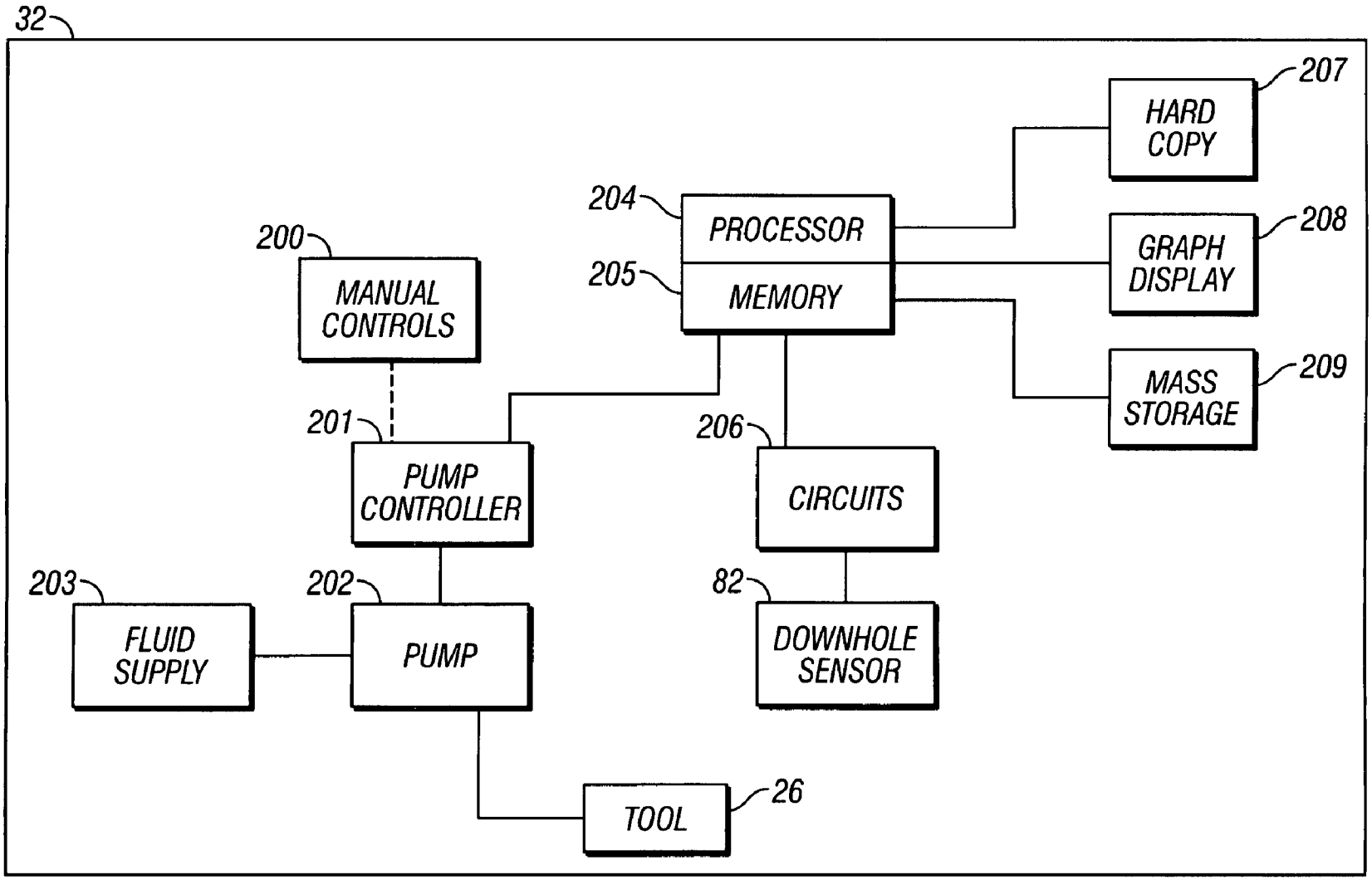
FIG. 5 is a block diagram of the surface monitoring and control system according to one embodiment of the present invention.

Referring to FIGS. 2 and 5, it is noted that a sensor 82 is operably associated with the fluid control line 34*a* to detect the amount of fluid pressure within the line 34*a*. In one embodiment, sensor 82 is a pressure sensor that is physically positioned at or near the housing 38 of the flow control device 26 to minimize the fluid storage effects of the control line 34*a*. Alternatively, sensor 82 may be a flow sensor that directly measures the amount of fluid passing through control line 34*a* and into, or out of, the appropriate chamber in flow control device 26. A data line 84 extends from the sensor 82 upwardly to the monitoring and control station 32. In one embodiment, data line 84 comprises an electrical and/or optical conductor. Readings detected by the sensor 82 are transmitted to the station 32 over dataline 84. Alternatively, readings of sensor 82 might be transmitted wirelessly to the surface, such as for example by acoustic techniques and/or electromagnetic techniques known in the art. Although a sensor is only shown affixed to control line 34*a*, it will be understood that sensors may be attached to either, or to both, control lines 34*a*, 34*b*.

Monitoring and control station 32 functionally comprises a hydraulic system for powering the flow control system and suitable electronics and computing equipment for powering downhole sensor 82 and detecting, processing, and displaying signals therefrom. In one embodiment, monitoring and control station 32 provides feedback control using signals from sensor 82 to control the hydraulic supply system. Monitoring and control station 32 comprises pump controller 201 controlling the output of pump 202 having fluid supply 203. Fluid from pump 202 powers downhole tool 26. In addition, processor 204, having memory 205 is associated with circuits 206 to provide power and an interface with sensor 82. Signals from sensor 82 are received by circuits 206 and then transmitted to processor 204. Processor 204, acting according to programmed instructions, provides a record and/or storage of the pressure vs. time of from sensor 82 using hard copy 207, display 208, and mass storage 209. In one embodiment, the length of time (x) associated with each sleeve movement, as described previously, may be stored in memory 205. The measured length of time (x) is compared to the stored signatures and the sleeve position determined based on the comparison. In another embodiment, the pressure profile for each movement is stored in memory 205 and a measured profile is compared to those in memory to determine the sleeve position. Alternatively, manual controls 200 may be operator controlled to operate the hydraulic system.

While described herein as a system having dual hydraulic control lines and a balanced piston, it will be appreciated by one skilled in the art that the present system is intended to encompass a single hydraulic line system utilizing a piston having a spring return capability.

Those of skill in the art will recognize that numerous modifications and changes may be made to the exemplary designs and embodiments described herein and that the invention is limited only by the claims that follow and any equivalents thereof.

What is claimed is:

1. A flow control device for use in a wellbore to allow flow of formation fluid into the wellbore, comprising:

a valve member adapted to move to control flow into the wellbore;

a fluid line supplying a working fluid under pressure to move the valve member;

a sensor in the wellbore and associated with the fluid line; and a controller that receives signals from the sensor, wherein the controller includes preprogrammed instructions for recording a sensor measurement and an associated time value for a movement of the valve member.

2. The flow control device of claim 1 wherein the valve member is adapted to move into a plurality of positions.

3. The flow control device of claim 2 wherein the device includes a first and a second fluid chamber cooperating to move the valve member to the plurality of positions in a stair-step fashion.

4. The flow control device of claim 2 wherein the plurality of positions correspond to a plurality of J-slots.

5. The flow control device of claim 1 wherein the sensor is located proximate the valve member, and wherein the sensor is chosen from the group consisting of: (i) a pressure sensor, and (ii) a flow sensor.

6. The flow control device of claim 1 wherein the controller determines the position of the valve member based on signals received from the sensor.

7. The flow control device of claim 6 wherein the controller has a stored pressure profile relating to the position of the valve member, the controller comparing a measured pressure with the stored pressure profile to determine the position of the valve member.

8. The flow control device of claim 6 wherein the controller determines the position of the valve member by comparing signals from the sensor with a predetermined signature stored in a memory associated with the controller.

9. The flow control device of claim 6 where the controller includes preprogrammed instructions for monitoring the flow of control fluid that is applied to the valve member to determine which one of the predetermined positions to which the flow control device has shifted.

10. The flow control device of claim 1 wherein the valve member has at least one intermediate position between an open position and a closed position; the sensor providing an indication of the at least one intermediate position.

11. The flow control device of claim 10 wherein the sensor measures pressure.

12. The flow control device of claim 11 further comprising a controller that receives signals from the sensor and determines a pressure associated with the at least one intermediate position.

13. The flow control device of claim 1 wherein the valve member includes a plurality of predetermined positions, and wherein the valve member is configured to shift into a selected predetermined position within the plurality of predetermined positions by controlling a time during which a pressure is applied to the valve member.

14. The flow control device of claim 1 wherein the valve member includes a j-slot valve that is configured to shift to a selected predetermined position within a plurality of predetermined positions; and wherein the controller includes preprogrammed instructions for monitoring the time during which the pressure is applied to the valve member to determine which one of the predetermined positions to which the flow control device has shifted.

15. The flow control device of claim 1 wherein the sensor is one of: (i) a pressure sensor, and (ii) a flow sensor.

16. The flow control device of claim 1 wherein the valve member is configured to shift into a selected predetermined position within the plurality of predetermined positions by controlling the flow of control fluid that is applied to the valve member.

17. A downhole flow control device comprising:

a hydraulically-actuated sleeve valve that is operable between a first position wherein the valve is in a first fluid flow state and a second position wherein the valve is in a second fluid flow state;

a hydraulic control line operably associated with the sleeve valve for the supply of hydraulic fluid to operate the valve between states; and a downhole pressure sensor operably associated with the hydraulic control line to detect fluid pressure therein to provide an indication of a position of the sleeve valve; and a controller that receives signals from the downhole pressure sensor, wherein the controller includes preprogrammed instructions for recording a pressure value and an associated time value for a movement of the sleeve valve.

18. The flow control device of claim 17 wherein the pressure sensor is located proximate the sleeve valve.

19. A method of determining a position of a flow control tool within a wellbore comprising:

supplying fluid under pressure to the flow control tool to move a flow control member of the tool into the position;

detecting pressure of the supplied fluid downhole;

recording the detected pressure and an associated time value for a movement of the flow control member; and determining the position of the flow control device using the detected pressure of the supplied fluid and the associated time value.

20. The method of claim 19 further comprising, providing a controller at a surface location that determines the position of the flow control tool from the detected pressure and the associated time value.

21. The method of claim 20 further comprising storing in the controller a pressure profile relating to movement of the flow control member and comparing the detected pressure with the pressure profile to determine the position of the flow control tool.

22. The method of claim 19 wherein the flow control member is adapted to move to a plurality of positions.

23. The method of claim 22 further comprising detecting each of said plurality of positions from a pressure profile associated with each said state.

24. A method of determining a position of a flow control tool within a wellbore, comprising:

associating a pressure profile with a movement of the flow control tool;

detecting fluid flow downhole within a hydraulic supply conduit in fluid communication with the flow control tool;

recording a pressure value and an associated time value for a movement of the flow control tool; and determining the position of the flow control tool from the detected fluid flow and the pressure profile.

25. The method of claim 24, wherein the fluid flow is detected with a sensor chosen from the group consisting of: (i) a pressure sensor, and (ii) a flow sensor.

26. The method of claim 24, further comprising providing a controller at a surface location that determines the position of the flow control tool from the downhole detected fluid flow.

27. The method of claim 26, further comprising storing in the controller the pressure profile relating to the movement of the flow control tool.

28. The method of claim 24, wherein the position comprises a plurality of positions and wherein the pressure profile is further associated with each of the plurality of positions.

29. A flow control device for use in a wellbore to control formation fluid flow into the wellbore, comprising:

a valve member having at least one intermediate position between an open position and a closed position;

a fluid line supplying a working fluid under pressure to move the valve member;

a pressure sensor in the wellbore and associated with the fluid line to provide an indication of a position of the valve member, wherein the sensor provides an indication of the at least one intermediate position; and a controller that receives signals from the sensor and determines a pressure associated with the at least one intermediate position, wherein the controller associates a time value with the determined pressure.

* * * * *